United States Patent [19]

Töpfl et al.

[11] Patent Number: 4,822,374

[45] Date of Patent: Apr. 18, 1989

[54] PROCESS FOR THE AFTERTREATMENT OF DYED CELLULOSE FIBERS

[75] Inventors: Rosemarie Töpfl, Dornach; Jörg Binz, Reinach, both of Switzerland

[73] Assignee: Ciba-Geigy Corporation, Ardsley, N.Y.

[21] Appl. No.: 60,288

[22] Filed: Jun. 10, 1987

[30] Foreign Application Priority Data

Jun. 17, 1986 [CH] Switzerland ..... 2437/86

[51] Int. Cl.[4] ..... C09B 67/00

[52] U.S. Cl. ..... 8/554; 8/568; 8/604; 525/328.3

[58] Field of Search ..... 8/554, 568, 604; 525/328.3

[56] References Cited

U.S. PATENT DOCUMENTS

| | | | |
|---|---|---|---|
| 3,686,151 | 8/1972 | Kelm | 260/79.3 A |
| 3,966,694 | 6/1976 | Espy | 526/11.2 |
| 4,439,203 | 3/1984 | Runyon | 528/250 |
| 4,511,707 | 4/1985 | Runyon | 8/496 |
| 4,583,989 | 4/1986 | Ueda | 8/543 |
| 4,592,758 | 6/1986 | Fikentscher | 8/567 |
| 4,678,474 | 7/1987 | Ueda | 8/543 |

OTHER PUBLICATIONS

CA, 87:137246a, Harada et al, 1977.
CA, 103:124944a, Daiichi, 1985.

*Primary Examiner*—John F. Niebling
*Assistant Examiner*—Isabelle Rodriguez
*Attorney, Agent, or Firm*—Edward McC. Roberts

[57] ABSTRACT

A process for the aftertreatment of dyed cellulosic fibre material for the improvement of wet fastness properties, comprising the use of an aqueous liquor which contains a polyquaternary ammonium compound obtained by the reaction of an epihalohydrin with a linear polymer which has repeating units of formula

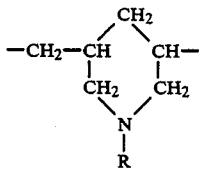

(1)

wherein R is $C_1$-$C_6$-alkyl.

10 Claims, No Drawings

PROCESS FOR THE AFTERTREATMENT OF DYED CELLULOSE FIBERS

The present invention relates to a process for the aftertreatment of dyed cellulose fibre material, in particular cellulosic textile material.

Dyeings and prints with substantive dyes often display insufficient wet fastness, in particular washfastness and water fastness. The dye, which is covalently bound to the surface of the cellulose, may be removed again by repeated washing operations and the bled dye may be taken up again onto undyed textile material washed in the same washing process.

Many attempts have been made to overcome this problem. Thus it is, for example, possible by means of aftertreatment with a conventional cationic aftertreatment agent, e.g. of the Tinofix EWA type, to improve water fastness and to also achieve a slight improvement in washfastness. This improvement is, however, not permanent. With repeated washing operations, in particular under alkaline conditions and at elevated temperatures, for example above 50° C., the conventional cationic aftertreatment agent is once again released from the textile material and this means that the dyeing loses its improved washfastness again.

It was hoped, through the use of reactive dyes, to have solved the problem of wet fastness, since these dyes form a chemical bond with the cellulose. It was, however, found that this fibre-dye bond is not optimally resistant to acid hydrolysis. This, in turn, results in a hydrolysed dyeing of this type not being fast in a washing operation, for example boiling. That proportion of the dye which is no longer chemically bound is dissolved in the wash bath and is thus able, for example, to soil an undyed textile article washed during the same washing operation. A further disadvantage is the unsatisfactory behaviour of the fibre/dye bond at elevated temperatures in dry air; conditions such as those encountered during the thermofixing of, for example, cotton/polyester blended fabrics. This fibre/dye bond is in part destroyed again at temperatures above 180° C., which may also lead to loss of dye during a washing process. A major disadvantage of dyeing using reactive dyes is, moreover, that non-fixed dye cannot be satisfactorily washed off. Several very laborious washing and rinsing procedures are needed in order to remove non-fixed dye from the fibre.

A new aftertreatment process has now been developed which significantly improves, in particular, the wet fastness of cellulose dyeings which have been produced using substantive dyes. It has, for example, been possible to improve washfastness under alkaline conditions at temperatures of over 50° C. and particularly in the case of the currently conventional washing at 60° C. using sodium perborate-containing detergents (ISO 105/C06 C2S). In the same way it is possible to extensively suppress the deleterious influence of acid hydrolysis and thermocracking during reactive dyeings by means of the aftertreatment process of the invention.

The instant invention thus relates to a process for the aftertreatment of dyed cellulosic fibre material which comprises treating said material with an aqueous liquor containing a polyquaternary ammonium compound obtained by reacting an epihalohydrin with a linear polymer containing recurring units having the formula

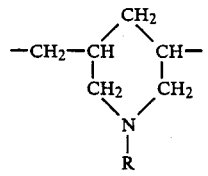

(1)

wherein R is $C_1$–$C_6$-alkyl.

Suitable alkyl groups R are methyl, ethyl, propyl, isopropyl, n-butyl, isobutyl, tert.butyl, n-amyl, isoamyl, tert.amyl, hexyl or 2-ethylbutyl. Ethyl and particularly methyl are preferred.

Polymers with units of formula (1) may be produced by polymerization of the hydrohalide salt of a diallylamine of formula

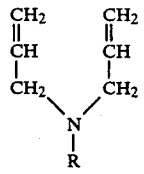

(2)

wherein R has the meaning given above, preferably in the presence of a free radical catalyst, and subsequent neutralization of the hydrohalide salt, for example with aqueous sodium hydroxide solution to give the polymeric free base.

Specific hydrohalide salts of diallylamines which may be polymerized to polymers of formula (1) are
N-methyl diallylamine hydrochloride,
N-methyl diallylamine hydrobromide,
N-ethyl diallylamine hydrochloride,
N-ethyl diallylamine hydrobromide,
N-isopropyl diallylamine hydrochloride,
N-n-butyl diallylamine hydrobromide,
N-tert.butyl diallylamine hydrochloride,
N-n-hexyl diallylamine hydrochloride.

Free radical-forming catalysts which may be used are symmetrical peroxide dicarbonates, peroxide dicarbamates, perbenzoates, perborates, persulphates or perioxide sulphates. The preferred catalyst is potassium persulphate or azobisisobutyronitrile or, preferably azobis(2-amidinopropane) hydrochloride.

These catalysts may be used in amounts of 0.05 to 5% by weight, preferably 0.5 to 2% by weight, based on the N-alkyl diallylamine.

The epihalohydrin whih is reacted with the N-alkyl diallylamine polymer may be any epihalohydrin, for example, epibromohydrin, epifluorohydrin, epiiodohydrin, beta-methyl epichlorohydrin, or preferably epichlorohydrin.

The epihalohydrin is used in an amount of 0.5 to 1.5 mol, preferably 1 to 1.5 mol per mol of the sum of the tertiary amines in the polymer.

The reaction conditions for the production of the polyquaternary polymers should be so chosen that there is no premature exchange of mobile substituents, either as a result of excessively high pH values of the reaction medium or as a result of excessively high temperature. It is consequently preferable to work in a dilute, aqueous medium at the mildest possible temperature and pH values, conveniently at a temperature of 30° to 85° C. and a pH of 6 to 8.5 preferably 7 to 8, whereby a hydrohalic acid, preferably hydrochloric acid, is used to attain the desired pH and to form the hydrohalide.

The aftertreatment of the invention of the dyed cellulosic fibre material is generally carried out after a dying, but preferably in a fresh bath.

The fibre material may be regenerated or, in particular, natural cellulose, for example, spun rayon, viscose silk, hemp, linen, jute or preferably cotton, as well as blends with synthetic fibres, for example those made from polyamide/cotton or in particular from polyester/cotton, whereby the polyester portion may be predyed with disperse dyes.

The textile material may be used in any form such as, for example, flocks, yarns, cheeses, yarn hanks, wovens, knits or felts, composed wholly or in part of natural or regenerated cellulose.

The dyeing of the cellulose fibre material is in general effected using reactive dyes or preferably substantive dyes. This may be accomplished using the exhaust dyeing method or by means of two-stage processes such as, for example, the pad dyeing method or printing. Suitable pad dyeing methods are, in particular, the so-called pad-steam process, thermofix process or the cold pad-batch process.

The amount of dye used depends on the intensity of colour desired. In general, amounts of 0.1 to 10% by weight, in particular 0.5 to 5% by weight based on the material used have proved satisfactory.

Suitable substantive dyes are the conventional direct dyes, for example the direct dyes listed in the Colour Index, 3rd Edition (1971) Volume 2 on pages 2005–2478.

By reactive dyes are meant the conventional dyes which form a chemical bond with cellulose, for example the reactive dyes listed in the Colour Index, Volume 3 (3rd Edition, 1971) on pages 3391–3560 and in Volume 6 (revised 3rd Edition, 1975) on pages 6268–6345.

The advantages of the process of the invention are especially evident in the aftertreatment of dyeings produced with substantive dyes. Particularly appropriate are azo dyes and anthraquinone dyes and, above all, polyazo dyes with 2 to 6 sulphonic acid groups.

The aftertreatment of the invention is preferably carried out by the exhaust dyeing process.

The liquor ratio may be chosen within a wide range, for example, from 1:4 to 1:100, preferably from 1:5 to 1:40, No special apparatus is required. It is possible for example to use standard dyeing apparatus such as open baths, winch vats; jiggers, paddle, jet, or circulation dyeing machines.

The process may conveniently be carried out at a temperature of from 20° to 70° C., preferably 30° to 50° C. The treatment time may be 20 to 60 minutes, although a treatment time of 30 to 40 minutes is generally sufficient. This conveniently comprises 15 to 20 minutes' treatment with the cationic aftertreatment agent, then addition of the alkali and a furthe 15 to 20 minutes' treatment to fix the aftertreatment agent.

Independent of the liquor ratio the aftertreatment agent is preferably used in an amount of 0.5 to 5% by weight, preferably 0.8 to 2% by weight of active ingredient content, based on the weight of the cellulose material, in order to achieve the desired degree of fastness.

Apart from the cationic aftertreatment agent, the liquors used in accordance with the invention also contain alkalies such as, for example, sodium hydroxide or potassium hydroxide. A 30% aqueous sodium hydroxide solution is preferably used in an amount of 2 to 10 ml/l, preferably 4 to 6 ml/l of liquor. The alkali may be added to the liquor at the outset with the cationic aftertreatment agent or preferably after 15 to 20 minutes' treatment with the aftertreatment agent.

The pH of the treatment liquors may thus in general be 8 to 13.5, preferably 10.5 to 13.

The liquors may also contain other conventional additives, for example electrolytes such as sodium chloride or sodium sulphate, dispersing and wetting agents as well as antifoams and other cationic fixing agents, which latter may also be fibre-reactive.

The aftertreatment of the cullulosic material is conveniently conducted in such a way that the material is treated after a dyeing, but in a fresh bath, with an aqueous liquor containing the aftertreatment agent, alkali and, if desired, an electrolyte, preferably sodium sulphate. The dyed cellulosic materials are preferably placed in a liquor containing the aftertreatment agent and sodium sulphate and having a temperature of 30° C. with the dyed material being treated at this temperature for 15 to 20 minutes, preferably 15 minutes. An alkali is added thereto and the material is then treated for a further 15 to 20 minutes at 30° C.

Following the aftertreatment of the invention, the cellulosic material may be rinsed with water, if desired neutralized with acetic acid and then dried in conventional manner.

Using the process of the invention there are obtained on cellulosic fibre material dyeings and prints which have been produced with reactive dyes and especially with substantive dyes and which exhibit a considerable improvement in wet fastness for example, washfastness and water fastness.

There is no deleterious influence on colour yield, shade and light fastness of the dyeings. Nor do the aftertreated dyeings and prints display any stiffening.

In the following Preparatory Instructions and Examples, the percentage given are by weight, unless otherwise stated. In the case of the dyes, the amounts relate to commercially available, i.e. finished goods and, in the case of the auxiliary agents, to active substance.

PREPARATORY EXAMPLES

EXAMPLE 1

101.4 g of 30% hydrochloric acid are added dropwise over 30 minutes at 20° C. to 92.5 g of N-methyl diallyl amine and the mixture is stirred until a homogenous solution is formed. The temperature is then raised to 60° C. and the solution mixed with 13.5 g of a 10% aqueous potassium persulphate solution, whereupon the temperature rises over 45 minutes to 80° C. Post-polymerization is then effected for 5 hours at 70° C. and the product is diluted with 696.75 g of water. The viscosity, measured using a Brookfield LV viscosimeter, is 850 mPa.s before dilution. After cooling to 40° C. the pH is adjusted to 7.8 by addition of 11 g of a 30% aqueous sodium hydroxide solution. 77 g of epichlorohydrin are then added dropwise over 20 minutes at 50° C. and stirring is continued for a further 1 hour. Then 20 g of 37% hydrochloric acid are added and the bath is stirred at low temperature.

1012 g of a clear, low viscosity solution are obtained, the active ingredient content of which is 16.7%.

EXAMPLE 2

98.64 g of 37% hydrochloric acid are added dropwise over 30 minutes at a maximum of 20° C. to 125 g of N-ethyl diallylamine and the mixture is stirred until a homogenous solution is obtained. The temperature is then increased to 60° C. and the solution mixed with 9.35 g of a 10% aqueous solution of 2,2'-azobis(2-amidino propane) dihydrochloride, whereupon the temperature rises over 60 minutes to 85° C. 21.8 g of a 10% aqueous solution of 2,2'-azobis-(2-amidino propane) dihydrochloride are then added dropwise over 30 minutes, whereby the temperature rises to 92° C. Stirring is then continued for 6 hours at 80° C. after which the mixture is cooled to 45° C. The viscosity, measured in a Brookfield LV viscosimeter at 25° C., is 910 mPa.s. The mixture is then diluted with 830 g of water and adjusted to a pH of 6.5 by the addition of 10g of a 30% aqueous sodium hydroxide solution. 92.5 g of epichlorohydrin are then added dropwise over 40 minutes at 45° C., whereby the temperature is maintained at 50° C., and stirring is continued at 50° C. for 1 hour. Then a solution of 28 g of 37 % hydrochloric acid in 48 g of water is added and the bath is stirred at low temperature. 1263 g of a clear, low viscosity solution are obtained, the active ingredient content of which is 20%.

EXAMPLE 3

88.8 g of 37% hydrochloric acid are added dropwise over 30 minutes at a maximum temperature of 20° C. to 125 g of N-isopropyl diallylamine and the mixture is stirred until a homogenous solution is obtained. The temperature is then raised to 60° C. and the solution is mixed with 9.38 g of a 10% aqueous solution of 2,2'-azobis-(2-amidino propane) dihydrochloride, whereupon the temperature rises over 50 minutes to 71° C. 21.9 g of a 10% aqueous solution of 2,2'-azobis(2-amidino propane-)dihydrochloride are then added dropwise over 50 minutes, whereupon the temperature rises to 95° C. Stirring is continued for 7 hours at 80° C. and the mixture is then cooled to 45° C. The viscosity, measured using a Brookfield LV viscosimeter at 25° C., is 750 mPA.s. The mixture is then diluted with 793 g of water and adjusted to a pH of 6.8 by the addition of 8.5 g of a 30% aqueous sodium hydroxide solution. 83.25 g of epichlorohydrin are then added dropwise over 30 minutes at 45° C., whereby the temperature is maintained at 50° C., and the mixture is stirred for 1 hour at 50° C. Then a solution of 28 g of 37% hydrochloric acid in 48 g of water is added and the bath is stirred until cold. 1205.5 g of a clear, low viscosity solution are obtained, the active ingredient content of which is 20%.

APPLICATION EXAMPLES

EXAMPLE 1

20 g of bleached and mercerized cotton tricot are each dyed separately using a conventional exhaust dyeing method with (1) 1.9% of a dye having the formula

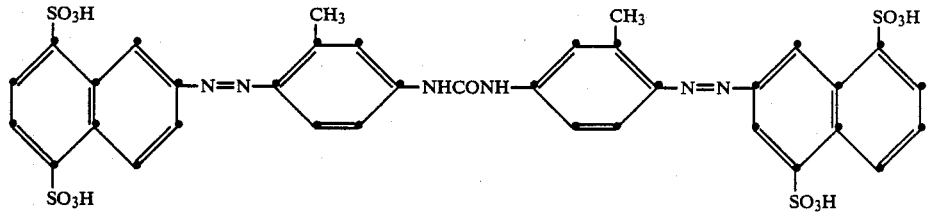

(101)

(2) 1.5% of a dye having the formula

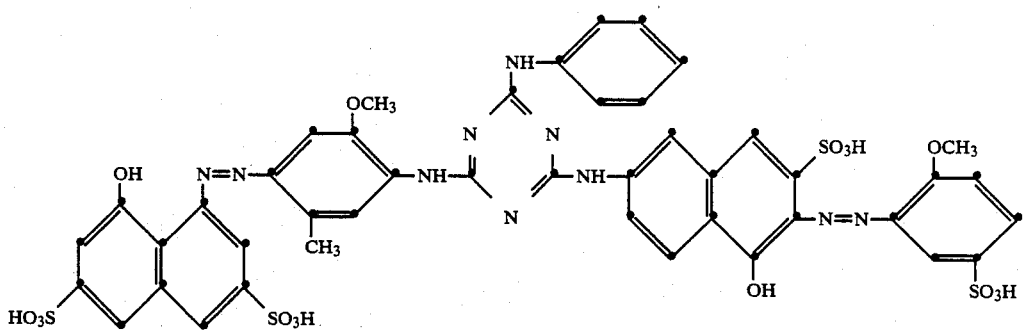

(102)

or (3) 1.2% of a dye having the formula

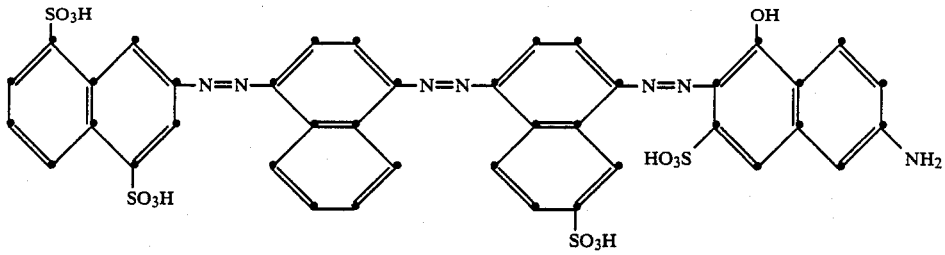

(103)

and then rinsed for 5 minutes in cold water, to give respectively a yellow, red and blue dyeing.

These three dyeings (20g each) are treated for 15 minutes at 30° C. and a liquor ratio of 1:20 with an aqueous liquor which contains 1.6% of the reaction product according to Preparatory Example 1 and 5 g/l of calcined sodium sulphate. 5 ml/l of a 30% sodium hydroxide solution are then added, whereupon the dyeings are again treated for 15 minutes at 30° C.

These aftertreated dyeings were then tested for the following fastness properties:

Washing No. 3 (SN ISO 105/C03)

ISO C2S washing (ISO 105/C06 C2S)

Xenon light (SN ISO 105/B02)

Corresponding dyeings, each aftertreated with 3% Tinofix EWA, were also tested simultaneously.

The fastness values are set out in Table 1.

EXAMPLE 2

(A) 20 g of non-mercerized cotton cretonne are pad dyed using a cold pad-batch process with an aqueous liquor containing 30 g/l of a dye having the formula

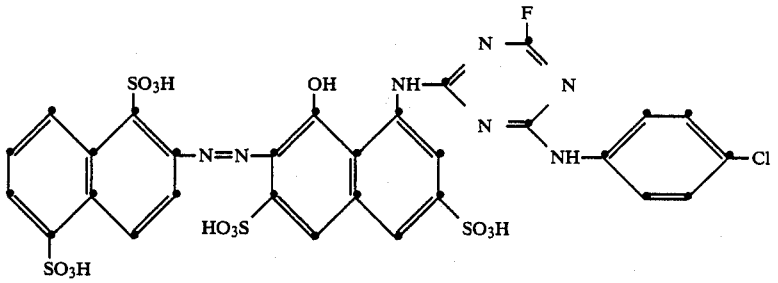

(104)

10 g/l calcined sodium carbonate 5 ml/l aqueous sodium hydroxide solution (30%) (pick-up 80 %), stored for 6 hours and liberated from non-fixed dye by frequent rinsing and washing.

(B) 20 g of this dyed cotton are treated at 30° C. for 15 minutes with an aqueous liquor containing 1.5% of the reaction product according to Preparatory Example 1. 5 ml/l of 30% sodium hydroxide solution are then added and the material treated for a further 15 minutes at 30° C.

A red dyeing is obtained which exhibits excellent fastness to acid hydrolysis.

A dyeing which is fast to acid hydrolysis is also obtained by using 30 g/l of a dye having the formula

TABLE 1

| | | Washing No. 3 bleed on | | | ISO C2S Washing bleed on | | | | | | | |
|---|---|---|---|---|---|---|---|---|---|---|---|---|
| Dyeings | Aftertreatment | Ae | CO | CV | Ae | CT | CO | PA | PES | PAC | CV | Xenon light |
| (1) | Tinofix EWA | 4 | 2 | 5 | 4–5 | 5 | 2 | 5 | 5 | 5 | 2 | 5 |
| (1) | Example 1 | 5 | 5 | 5 | 5 | 5 | 4–5 | 5 | 5 | 5 | 4–5 | 6 |
| (2) | Tinofix EWA | 4 | 2 | 5 | 4 | 5 | 2 | 4 | 5 | 5 | 2–3 | 3–4 |
| (2) | Example 1 | 4–5 | 5 | 5 | 5 | 5 | 4 | 5 | 5 | 5 | 4 | 4 |
| (3) | Tinofix EWA | 4 | 2 | 5 | 4 | 5 | 2 | 4–5 | 5 | 4–5 | 2 | 4 |
| (3) | Example 1 | 5 | 5 | 5 | 5 | 5 | 5 | 5 | 5 | 5 | 5 | 5 |

Ae = Change in shade
CT = Triacetate
CO = Cotton
PA = Polyamide
PES = Polyester
PAC = Polyacrylonitrile
CV = Viscose

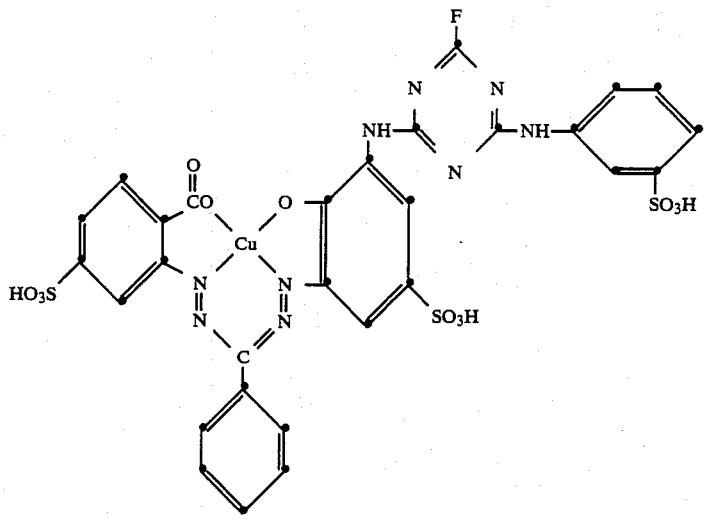

(105)

instead of the dye of formula (104) in (A) and treating the resultant dyeing according to (B). The results of the tests for acid hydrolysis are set out in Table 2.

TABLE 2

| Dye | After-treatment | Change in shade | Bleeding on cotton | Bleeding on wool |
|---|---|---|---|---|
| (104) | untreated | 4 | 4 | 2 |
| (104) | Example 2 | 5 | 5 | 5 |
| (105) | untreated | 4–5 | 4–5 | 3 |
| (105) | Example 2 | 5 | 5 | 5 |

EXAMPLE 3

The dyeing according to Example 2 (A) with subsequent aftertreatment (B) are repeated, except that the impregnated articles are exposed after pad-dyeing to dry heat on a hot air fixation apparatus for 2 minutes at 210° C. Following the aftertreatment, the test for fastness to water (severe) is carried out (SN ISO 105/E01) with multiple fibre band as adjacent fabric. The results of these tests are listed in Table 3.

TABLE 3

| Dye | After-treatment | Change in shade | Bleeding on CT | CO | PA | PE | PAC | WO |
|---|---|---|---|---|---|---|---|---|
| (104) | untreated | 4 | 3–4 | 4 | 3 | 3–4 | 3–4 | 3 |
| (104) | Example 3 | 5 | 5 | 5 | 5 | 5 | 5 | 5 |
| (105) | untreated | 4 | 4 | 2 | 3–4 | 4 | 4 | 3 |

TABLE 3-continued

| Dye | After-treatment | Change in shade | Bleeding on CT | CO | PA | PE | PAC | WO |
|---|---|---|---|---|---|---|---|---|
| (105) | Example 3 | 5 | 5 | 5 | 5 | 5 | 5 | 5 |

EXAMPLE 4

The procedure as described in Example 1 is carried out, but 2.4% of the reaction product according to Preparatory Example 2 is used for aftertreatment in place of the reaction product according to Preparatory Example 1.

These aftertreated dyeings are tested for the ISO C2S wash. The results are set out in Table 4.

TABLE 4

| Dyeing | Change in shade | Bleeding on cotton | Bleeding on viscose |
|---|---|---|---|
| (1) | 5 | 4–5 | 5 |
| (2) | 5 | 4–5 | 4–5 |
| (3) | 5 | 4–5 | 5 |

EXAMPLE 5

(A) A cheese of 500 g of bleached cotton yarn is dyed with an aqueous liquor which contains, at a liquor ratio of 1:20, 1.5% of a dye having the formula

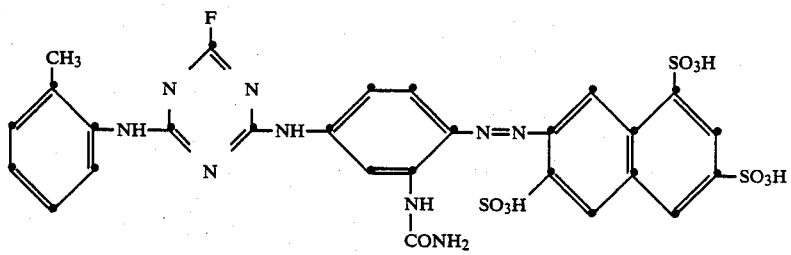

(106)

1.5% of a dye having the formula

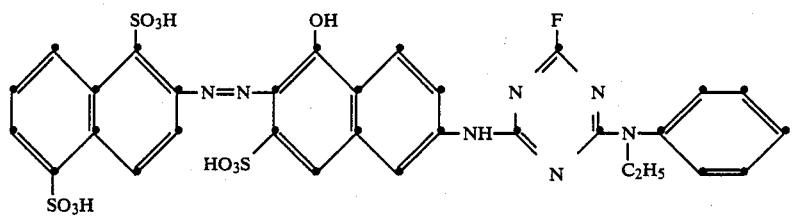

(107)

5% of a dye having the formula

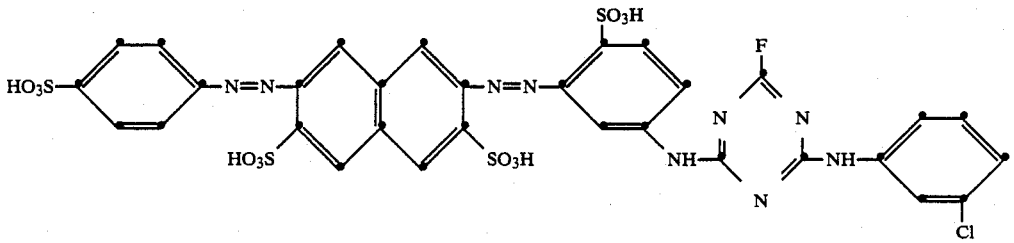

(108)

and 80 g/l of sodium sulphate, whereby the dyeing is conducted for 60 minutes at 50° C. Then 5 g/l of anhydrous sodium carbonate and 1 ml/l of 30 % sodium hydroxide solution are added to the dyebath, whereupon the goods are treated for a further 60 minutes at 50° C. The dyeing thereby obtained is then rinsed for 10 minutes in cold water for 10 minutes in water of 80° C. soaped at the boil for 10 minutes and rinsed for 10 minutes in water at 40° C.

(B) The black-dyeing obtained on cotton according to (A) is treated at 20° C. with an aqueous composition which contains 1.2% of the reaction product according to Preparatory Example 1 and 5 g/l of sodium sulphate at a liquor ratio of 1:20. The temperature is then raised to 50° C. over 20 minutes. 4 ml/l of 30% sodium hydroxide solution are added and the material is treated for a further 30 minutes at 50° C. The goods are then rinsed twice for 10 minutes in cold water and subsequently dried. A washfast black dyeing is obtained.

(C) 5% of a dye of formula (104) and 0.5% of a dye of formula

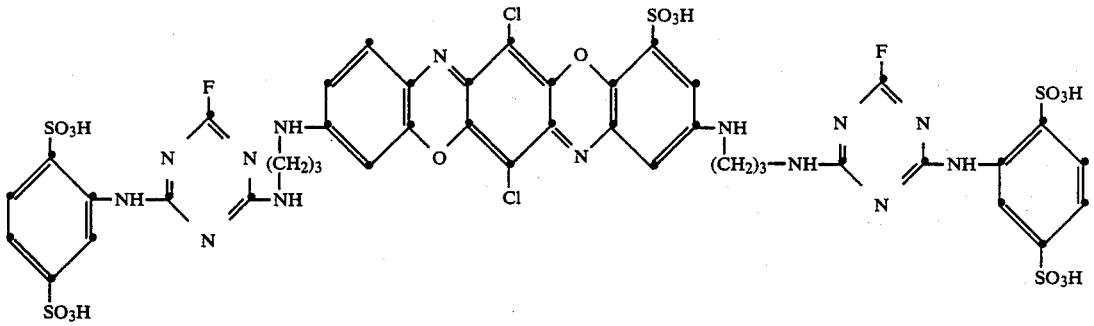

(109)

are used in (A) in place of the above dye mixture and the resultant violet dyeing is treated according to (B). A washfast dyeing is likewise obtained.

The results of the tests of the wash at the boil (Wash No. 4, SNV 195814/1962) are listed in Table 5 and compared with corresponding dyeings which have each been after-treated with Tinofix EWA.

TABLE 5

| After-treatment | Change in shade | Bleeding on cotton | Bleeding on viscose |
|---|---|---|---|
| Example 5 | 5 | 4–5 | 5 |
| Tinofix EWA | 3–4 | 2–3 | 3–4 |
| Example 5(C) | 5 | 4–5 | 5 |
| Tinofix EWA | 4–5 | 3 | 4 |

EXAMPLE 6

(A) A cheese of 500 g bleached cotton yarn is dyed in an aqueous liquor containing 2% of a dye of formula (102) at a liquor ratio of 1:20. The procedure commences at 40° C. and the temperature is raised over 30 minutes to 98° C. At intervals of 5 minutes in each case 3 portions of 6.5 g/l each of sodium sulphate are then added and dyeing is continued for a further 45 minutes at 98° C. The dyeing is then first rinsed for 10 minutes in water at 40° C. and 10 minutes in cold water, and subsequently treated with 1.2% of the reaction product according to Preparatory Example 1 as described in Example 5 (B). This aftertreated dyeing is then tested for the ISO C2S wash. A corresponding dyeing aftertreated with 3% of Tinofix EWA is also tested.

The results of the tests are set out in Table 6.

TABLE 6

| After-treatment | Change in shade | Bleeding on cotton | Bleeding on viscose |
|---|---|---|---|
| Tinofix EWA | 3–4 | 2–3 | 2–3 |

TABLE 6-continued

| After-treatment | Change in shade | Bleeding on cotton | Bleeding on viscose |
|---|---|---|---|
| Example 6 | 4–5 | 4–5 | 4–5 |

What is claimed is:

1. A process for the aftertreatment of dyed cellulosic fibers, which consists of treating said fibers with an aqueous liquor consisting essentially of a polyquaternary ammonium compound obtained by reacting an epihalohydrin with a linear polymer containing repeating units of the formula

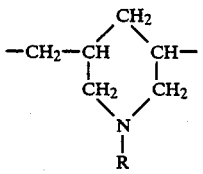

wherein R is $C_1$–$C_6$-alkyl.

2. A process according to claim 1, wherein the epihalohydrin is epichlorohydrin.

3. A process according to claim 1, wherein R is methyl, ethyl or isopropyl.

4. A process according to claim 3, wherein R is methyl.

5. A process according to claim 1, wherein the aftertreatment is carried out by the exhaust method.

6. A process according to claim 1, wherein the aftertreatment is carried out at a temperature of from 20° to 70° C.

7. A process according to claim 6, wherein the temperature range is from 30° to 50° C.

8. A process according to claim 1, wherein the aftertreatment is carried out in alkaline medium.

9. A process according to claim 1, wherein the aqueous liquor additionally contains 2 to 10 ml/l of a 30% aqueous sodium hydroxide solution.

10. A process according to claim 1, wherein the dyed cellulosic fibers are dyed with a reactive dye or a substantive dye.

* * * * *